US005131503A

United States Patent [19]

Billington, III et al.

[11] Patent Number: 5,131,503

[45] Date of Patent: Jul. 21, 1992

[54] VERTICALLY ADJUSTABLE WORK STATION ASSEMBLY

[75] Inventors: Charles J. Billington, III, Modesto; James H. Fox, Hillmar, both of Calif.

[73] Assignee: Billington Welding & Manufacturing, Inc., Modesto, Calif.

[21] Appl. No.: 647,924

[22] Filed: Jan. 29, 1991

[51] Int. Cl.[5] ..... B66B 11/04

[52] U.S. Cl. ..... 187/25; 187/24

[58] Field of Search ..... 474/113, 114, 136; 187/24, 25

[56] References Cited

U.S. PATENT DOCUMENTS

| | | | |
|---|---|---|---|
| 2,065 | 9/1865 | Miller | 187/25 |
| 103,546 | 5/1870 | Berger . | |
| 491,249 | 2/1893 | Reynolds | 187/24 X |
| 804,975 | 11/1905 | Porter . | |
| 828,029 | 8/1906 | Jackson | 187/25 |
| 848,804 | 4/1907 | Bruen . | |
| 1,250,108 | 12/1917 | Seymour . | |
| 1,566,223 | 12/1925 | Manor | 187/25 |
| 1,570,591 | 1/1926 | Mercer | 474/136 X |
| 2,445,004 | 7/1948 | Reynolds et al. . | |
| 3,067,893 | 12/1962 | Grove . | |
| 3,422,692 | 1/1969 | Woodring | 474/136 |
| 3,851,854 | 12/1974 | Roybal . | |
| 4,287,967 | 9/1981 | Perkins | 187/24 |
| 4,457,402 | 7/1984 | Del Vecchio et al. | 414/921 X |

OTHER PUBLICATIONS

Powerise Pneu-Spring, Austin Suppliers of Industrial, Vehicle and Commercial Hardware.

*Primary Examiner*—Joseph E. Valenza
*Assistant Examiner*—Dean A. Reichard
*Attorney, Agent, or Firm*—Flehr, Hohbach, Test, Albritton & Herbert

[57] ABSTRACT

A vertically adjustable work station for use proximate a conveyor belt or the like. The work station includes a platform with side rail assemblies that is mounted for vertical displacement to ground engaging support posts. The posts are telescoped inside the rail assembly and a displacement assembly is provided to raise and lower the platform on the posts. In one embodiment, the posts are externally threaded and belt-driven gear nuts are mounted on the posts and carry the platform. In another embodiment, the posts and side rails are formed to provide a fluid piston-cylinder assembly. In a final embodiment, a pneumatic constant force spring biases the rail assembly and platform upwardly from the posts, and a brake assembly is used to hold the platform at the desired elevation.

7 Claims, 7 Drawing Sheets

VERTICALLY ADJUSTABLE WORK STATION ASSEMBLY

FIELD OF THE INVENTION

This invention relates to a novel work station assembly for use in connection with conveyors of the type used in food processing, material handling, and manufacturing plants. More specifically, this invention relates to a vertically adjustable work station or platform assembly for use along a conveyor or the like to support personnel at an optimum height as they perform tasks relating to products on the conveyor.

BACKGROUND

In order for conveyor lines at food processing, material handling, manufacturing and other types of plants to function efficiently, each worker on the assembly line must be able to accomplish his task with essentially the same speed and accuracy as his co-workers. However, the productive output of workers on conveyor lines may be affected by the height of the worker. For example, a short worker may have a limited reach across a conveyor belt and, thus, may have to exert more effort than a tall worker to access material carried by the conveyor belt. Consequently, the shorter worker may tire more quickly or, more significantly, strain muscles from exertion. This physical strain tends to reduce individual productivity which can translate into a reduction of overall plant productivity. Moreover, the physical stress of the job may lead to worker discontentment and a high turn-over rate for employees.

In addition to the above-mentioned problem, the line of vision of a short worker is not as encompassing as that of a tall worker. So, a short worker responsible for quality control may not detect defective products carried by the conveyor belt as readily as a tall worker.

A temporary solution to the above described difficulties is for a shorter worker to stand on a relatively sturdy box, crate or the like placed adjacent the assembly line. Although crates offer an immediate height adjustment, the crates are typically not secured to a ground surface and, consequently, may topple over if a worker shifts his weight. This can lead to worker injuries. Moreover, such make-shift solutions to height adjustment rarely position the worker at precisely the best or optimum height for his or her stature.

In an attempt to reduce the potentially hazardous use of temporarily placed crates, some conveyor assembly lines have installed vertically adjustable step assemblies at each work site. These step assemblies generally include a step frame which can be selectively hooked or attached at various heights to the conveyor support framework, for example, by hooking the platform step to the appropriate apertures in the conveyor framework. Although such step assemblies are not subject to tipping, the assemblies may only be positioned at a fixed number of levels and do not provide a continuum of possible vertical positions. Consequently, only a limited range of workers actually benefit from installation of these permanently fixed step assemblies.

In order to accommodate a broader height range of workers, conveyor belts also have been positioned on a sloped floor surface. A worker may then choose a working site along a conveyor belt from a continuous range of positions. However, the structural design of a sloped working floor is somewhat impractical and does not accommodate many possible combinations of the height distributions in the work place.

Accordingly, it is therefore a general object of the invention to provide a vertically adjustable work station assembly which will obviate or minimize difficulties of the type previously described.

It is a specific object of the invention to provide a continuously vertically adjustable work station assembly which may be used to elevate a person to an optimum working height.

It is another object of the invention to provide a vertically adjustable work station assembly which accommodates a wide height range of persons and, thus, may be effectively used by any number of persons.

It is still another object of the invention to provide a vertically adjustable work station assembly which is easy to operate, durable, compact, has a minimum number of parts, is economical to construct and can be retrofit for use with a wide range of conveyor lines.

DISCLOSURE OF THE INVENTION

An embodiment of the invention which is intended to accomplish at least some of the foregoing objects includes a vertically adjustable work station assembly having a plurality of relatively spaced apart, externally threaded stationary posts which vertically extend from a ground surface. Gear nuts having an internally threaded bore are rotatably mounted on each stationary post. The gear nuts each have an upwardly facing smooth surface for supporting a platform which extends transversely between the gear nuts and preferably includes a side rail assembly for lateral support of a worker on the platform. A gear nut drive assembly simultaneously rotates the gear nuts about the threaded stationary posts to vertically displace the gear nuts relative to the stationary posts. The upper smooth surfaces of the gear nuts slidably contact the platform so that, as the gear nuts rotate, the platform is vertically carried by the gear nuts. In this manner, the platform may be elevated or lowered in relation to the stationary posts to permit a person standing on the platform to attain an optimum working height. In the preferred embodiment for compactness, the threaded posts are telescoped inside the side rail assembly carried by the platform.

In another embodiment of the subject invention, the work station assembly includes a platform which is movably mounted to a plurality of relatively spaced apart, vertically extending stationary posts. A side rail assembly extends upwardly from the platform to facilitate lateral support of a person standing on the platform. The side rail assembly includes vertically extending portions which are mounted in relatively telescoped relation to the stationary posts. Either the stationary posts or the vertically extending portions of the side rail assembly serve as a fluid cylinder, and the other acts as a piston in a hydraulic arrangement. The platform is vertically displaced by the side rail assembly which moves in response to pressurization of the fluid cylinder portion of the subject assembly by a fluid. A sliding fluid seal is provided between the stationary posts and the vertically extending portions of the side rail assembly to seal the fluid cylinder. A fluid conduit couples the fluid cylinder portion of the subject assembly to a fluid source to introduce fluid into the fluid cylinder. A valve assembly controls the selective pressurization of the fluid cylinder and the subsequent discharge of fluid from the fluid cylinder to produce vertical displacement of the platform of the work station assembly.

In a further alternative embodiment of the subject invention, the fluid cylinder and piston arrangement for elevating the platform is replaced with a spring biasing system coupled between the stationary posts and the side rail assembly. In this preferably pneumatic system, the spring biasing assembly biases the platform in an upward direction relative to the stationary posts. In order for the pneumatic embodiment of the subject work station assembly to operate correctly, the biasing force delivered to the platform must be greater than the platform weight but less than the combined weight of the platform and a person standing on the platform. A securement assembly, preferably a frictional brake assembly, releasably secures the platform against movement relative to the stationary posts. Selective adjustment of the vertical height of the platform relative to the posts in an upward direction is achieved by releasing the brake while not standing on the platform, while adjustment in a downward direction is achieved by releasing the brake while standing on the platform.

BEST MODE OF CARRYING OUT THE INVENTION

Figure 1:
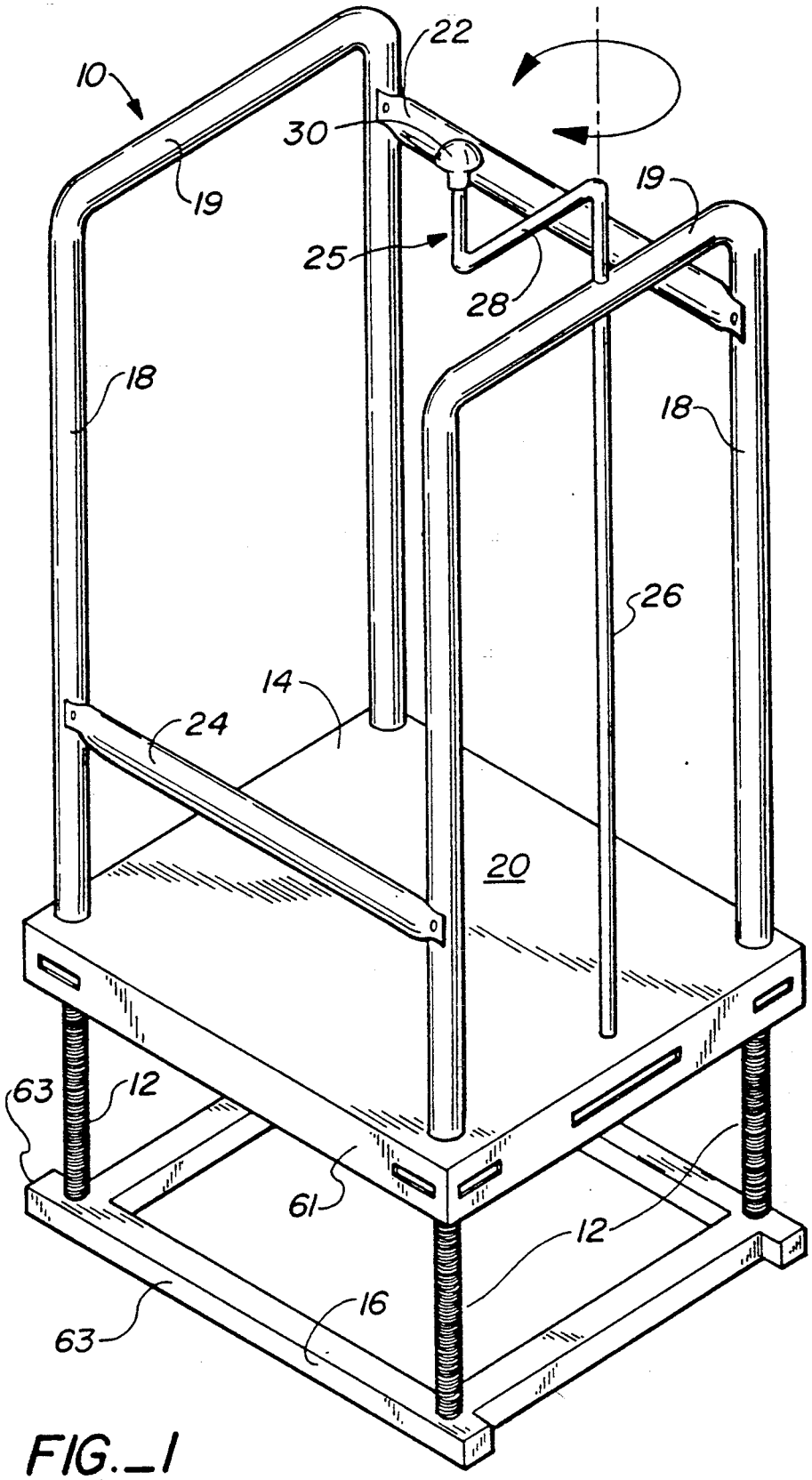
FIG. 1 is a top perspective view of the subject vertically adjustable work station assembly constructed in accordance with the invention.

Referring now to the drawings, wherein like numerals indicate like parts, and initially to FIG. 1, there will be seen a vertically adjustable work station assembly, generally indicated 10, constructed in accordance with the subject invention. More particularly, there will be seen a work station assembly 10 having four externally threaded stationary posts 12 positioned adjacent each corner of a platform 14. Platform 14, which may be perforated or otherwise provided with a non-skid surface, extends transversely relative to stationary posts 12 and may be vertically adjusted to raise or lower a person standing on platform 14, as will be described in more detail below in conjunction with FIGS. 3 and 4. The stationary posts 12 extend vertically upward from a ground or support surface engaging end, most preferably from a generally rectangular base frame 16.

Base frame 16 provides stability to the work station assembly and reduces the likelihood of the subject work station assembly of accidentally tipping. As will be seen in connection with the embodiment of FIGS. 5 and 6 however, each post can have its own foot assembly or merely rest on the ground. Frame 16 adds stability while allowing the work station to be easily moved along the conveyor line.

A pair of generally U-shaped side rail members 18 are mounted on opposite sides of platform 14 in an inverted "U" orientation. The legs of the "U" form tubular rail portions which extend vertically from the upper surface 20 of platform 14. Side rail members 18 are hollow so that stationary posts 12 may be telescoped inside the vertically extending portions of rail members 18. In addition, side rail members 18 are designed to extend vertically to a height sufficient to provide lateral support and preferably at least to waist height of a person standing on platform 14. This enables a person to use the horizontal top portions 19 of side rail members 18 as arm rests.

Work station assembly 10 also includes a back support bar 22 which transversely spans the pair of side rail members 18 to provide stability to the side rail assembly and is mounted to an upper segment of the vertically extending portions of side rail members 18. Back support bar 22 is mounted to side rail members 18 at a height to permit a person standing on platform 14 to comfortably lean back against support bar 22.

A foot support bar 24 transversely extends between the pair of side rail members 18 on a lower segment of the vertically extending portions opposite those carrying back support bar 22. A worker standing on platform 14 may rest a foot upon foot support bar 24 to achieve a more comfortable working position. Foot support bar 24 also adds to the overall rigidity of the side rail assemblies.

Here, support bars 22 and 24 are shown rivetted to the side rail members; however, it is to be understood that, in an alternative embodiment, the vertically extending portions of side rail members 18 may include a plurality of vertically spaced apertures for securement of support bars 22 and 24 at a plurality of locations along the vertically extending portions of side rail members 18. This would permit a worker to adjust the relative height positioning of the support bars relative to the platform to accommodate the worker's height.

A hand crank, generally designated 25, is mounted to the subject work station assembly 10 to permit a person standing on platform 14 to actuate a gear assembly mounted on the lower surface of the platform, as will be discussed below. Hand crank 25 extends vertically upward from platform 14 and through relatively horizontal arm rest portion 19 of one of side rail members 18. Hand crank 25 may be rotated in a clockwise or counter-clockwise direction, depending on whether a person desires to lower or elevate platform 14. Hand crank 25 includes a crank arm 28, crank shaft 26 and a knob 30 for a person to grasp to rotate the crank. The hand crank permits a person standing on the platform to adjust the vertical height of the platform to reach the person's optimum working position relative to a conveyor 32, or the like.

Figure 2:
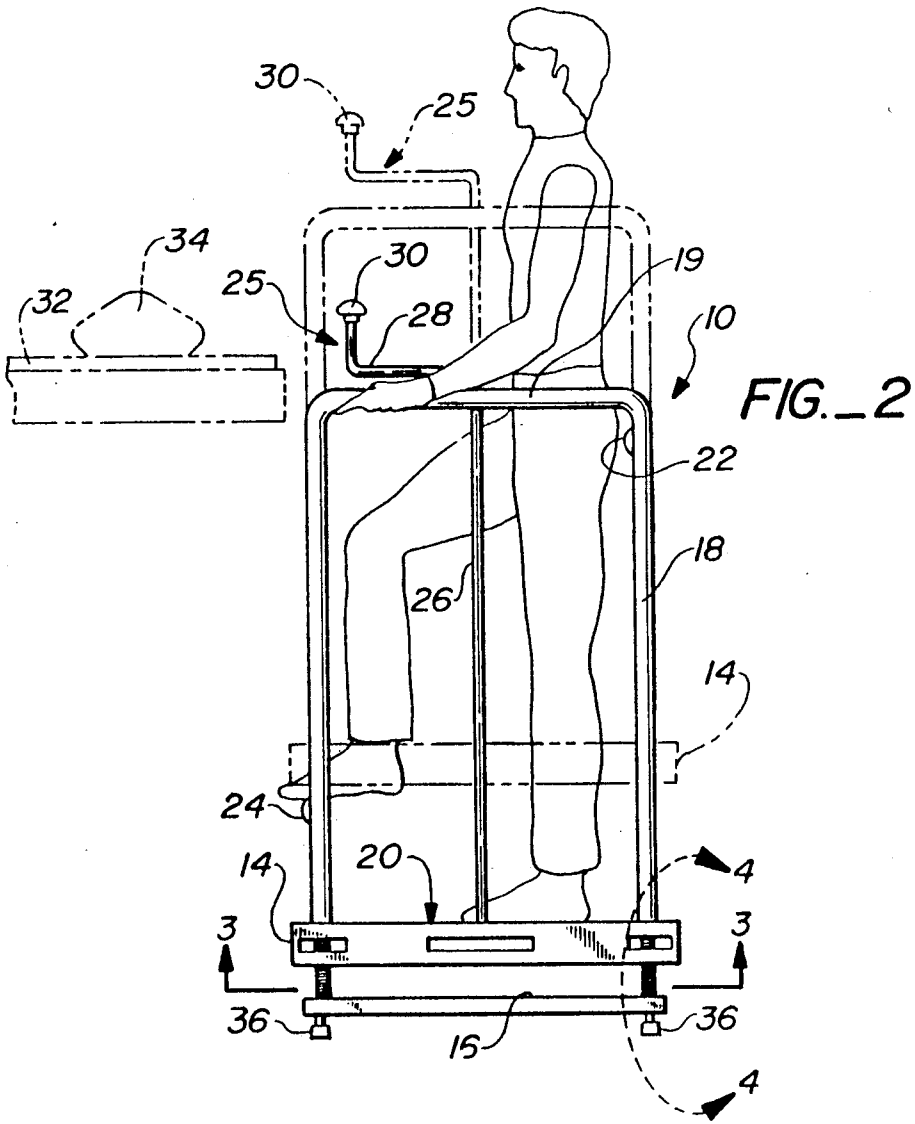
FIG. 2 is a side elevation view in reduced scale showing the subject invention installed next to a conveyor and depicting a worker standing on the work station platform.

FIG. 2 depicts a person or worker standing on platform 14 of work station assembly 10. Work station assembly 10 is positioned in front of a conveyor belt 32 carrying products 34. The person may raise platform 14 from a low position, as shown by solid lines, to an elevated position, as shown in phantom, by rotating crank arm 28, which turns crank shaft 26. A person in an elevated position may more readily access products travelling along the conveyor belt without straining to reach the products.

In order to reduce the risk of the subject assembly sliding across the ground surface, ground engaging members 36 are preferably adjustably mounted to the corners of base frame 16. The ground engaging members may be composed of rubber or any other suitable material having a high coefficient of friction and may be vertically adjustable for leveling of platform 14 on uneven or out-of-level support surfaces.

Figure 3:
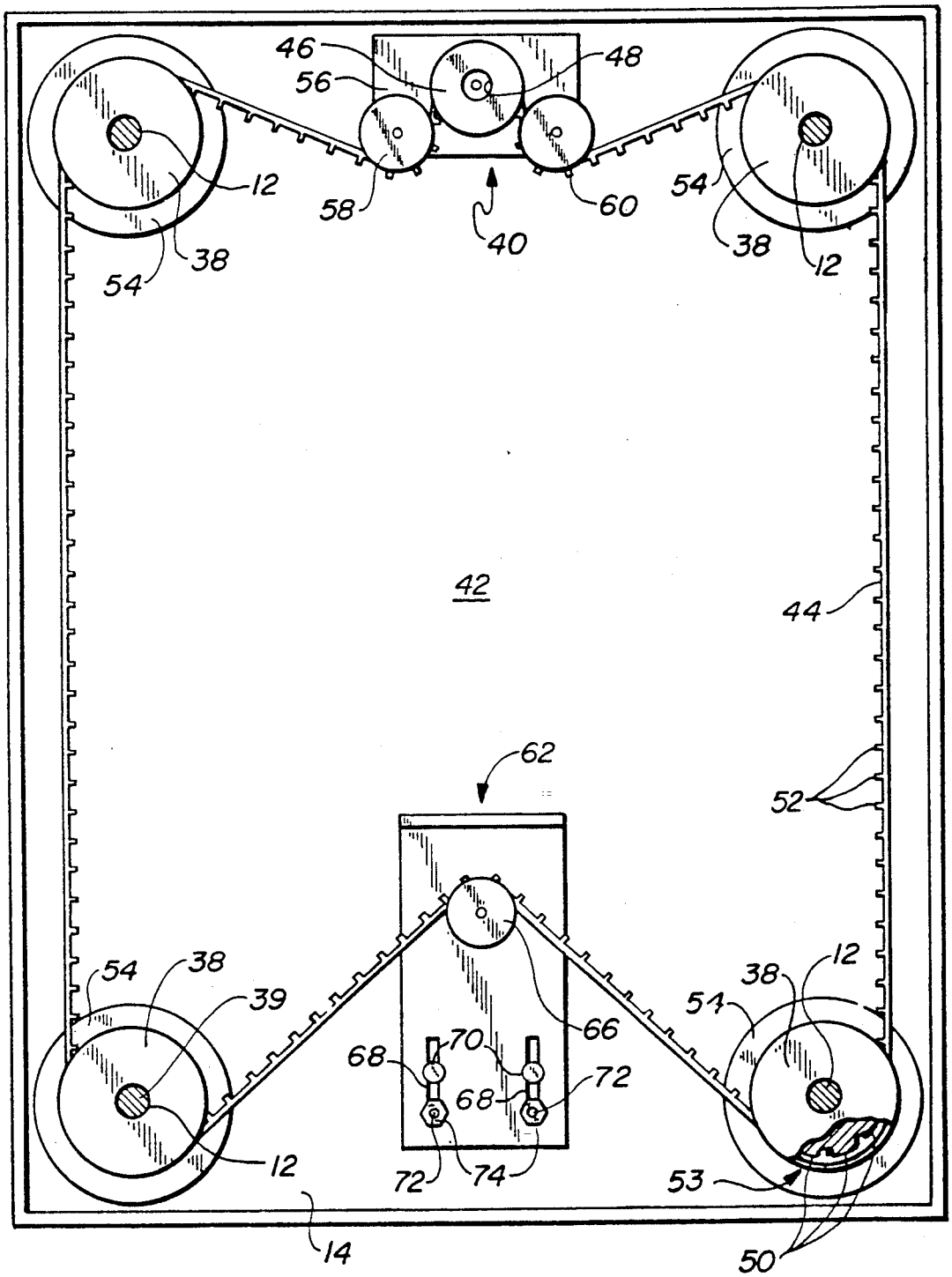
FIG. 3 is a bottom plan view of the platform of the subject invention, as taken substantially along line 3—3 in FIG. 2.

FIG. 3 is a bottom plan view of platform 14 of the subject invention. Four spool-like gear nuts 38 and a gear nut drive assembly, generally designated 40, are mounted to a lower side 42 of platform 14. Each gear nut 38 has a threaded inner bore 39 threadably engaged on the exterior threads 41 of an associated stationary post 12. Gear nut drive assembly generally includes, in addition to previously described hand crank assembly 25, a ribbed belt 44, such as a timing belt, and a rotatable drive gear 46 mounted on lower side 42 of platform 14. Drive gear 46 is keyed to crank shaft 26 which extends through platform 14 and into a central bore 48 of drive gear 46. Each gear nut 38 has a plurality of longitudinally extending ribs 50, which define recesses 53 therebetween and which extend substantially around the gear nuts. Ribs 52 of belt 44 are received in recesses 53 and driven by gear nut ribs 50. An annular flange 54, having a smooth, low coefficient of friction upper surface 55, rotatably engages lower side or surface 42 of platform 14. So, as rotatable drive gear 46 drives ribbed belt 44, gear nuts 38 freely rotate beneath platform 14 about stationary posts 12 and thereby to carry platform 14 up-and-down stationary posts 12. A suitable low-friction material for use in forming gear nuts 46 is DELRIN brand linear polyoxymethylene-type acetal resin, although it will be understood that other low coefficient of friction plastics and other materials can be used.

Rotatable drive gear 46 is separated from lower side 42 of platform 14 by a backing plate 56 mounted to platform 14. Backing plate 56 permits free rotation of drive gear 48, as well as rotation of a pair of follower spools 58 and 60 mounted to plate 56. The follower spools, which have smooth exterior vertical surfaces, train ribbed belt 44 around the periphery of rotatable gear 46 to ensure maximum engagement of the ribbed belt with the ribs of the rotatable gear. In addition, follower spools 58 and 60 vertically align ribbed belt 44 with drive gear 46 to prevent belt 44 from being disengaged from drive gear 46.

A belt tensioning and guide assembly 62 is mounted on lower side 42 of platform 14 opposite gear nut drive assembly 40. Belt tensioning and guide assembly 62 includes an adjustable mounting plate 64 and a tensioning spool 66 which is rotatably affixed to mounting plate 64. Mounting plate 64 has two relatively spaced apart, longitudinal slots 68 for receiving guide pins 70, which extend down from lower surface 42 of platform 14. Mounting plate 64 is secured to platform 14 by screws 72 which extend downward from platform 14 through slots 68 and nuts 74. By loosening nuts 74, mounting plate 64 may be repositioned with respect to lower side 42 of platform 14 to increase or, alternatively, decrease the tautness of ribbed belt 44.

Figure 4:
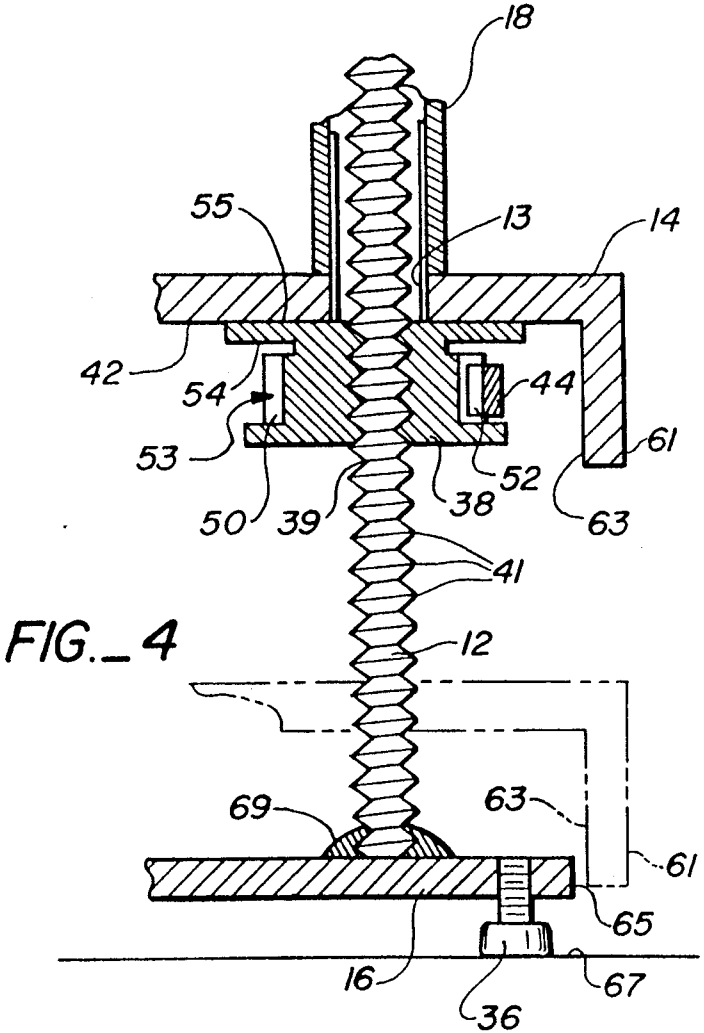
FIG. 4 is an enlarged, fragmentary view, in cross section, of the area bounded by line 4—4 in FIG. 2.

Referring particularly to FIG. 4, the method of raising and lowering the platform of the subject vertically adjustable work station assembly will now be discussed. Although the following discussion refers to a single corner of platform 14, it is to be understood that each corner of the platform is similar in design and mechanical operation and all corners are driven substantially simultaneously by the drive assembly.

Externally threaded stationary post 12 will be seen extending through a hole 13 bored in platform 14, and post 12 telescopes inside tubular side rail member 18. Gear nut 38 is rotatably mounted to post 12. As belt 44 rotates gear nut 38, internal threads 39 of gear nut 38 matingly engage threads 41 on the post and cause the gear nut to ride up-and-down stationary post 12. Platform 14 is carried by upper surface 55 of gear nut 38 and, thus, moves vertically in relation to stationary post 12 in response to movement of the ribbed gear belt.

The above-described embodiment of the work station assembly may be modified by substituting a sprocket and chain arrangement for the ribbed gears and ribbed belt arrangement without departing from the spirit and scope of the subject invention.

Moreover, in a further alternative embodiment of disclosed in FIGS. 1–4, the subject invention may undergo a reversal of parts so that the side rail members are telescoped inside a tubular externally threaded post.

As will be seen from FIG. 4, downwardly depending platform skirt 61 has an inner side 63 which preferably extends laterally beyond outer edge 65 of base frame 16 to permit the platform to be lowered to close proximity to support surface 67. As also will be appreciated, post 12 can be welded at 69 to the base frame, or threadably secured to the base frame. Similarly, feet 36 can be eliminated to further lower the assembly.

Figure 5:
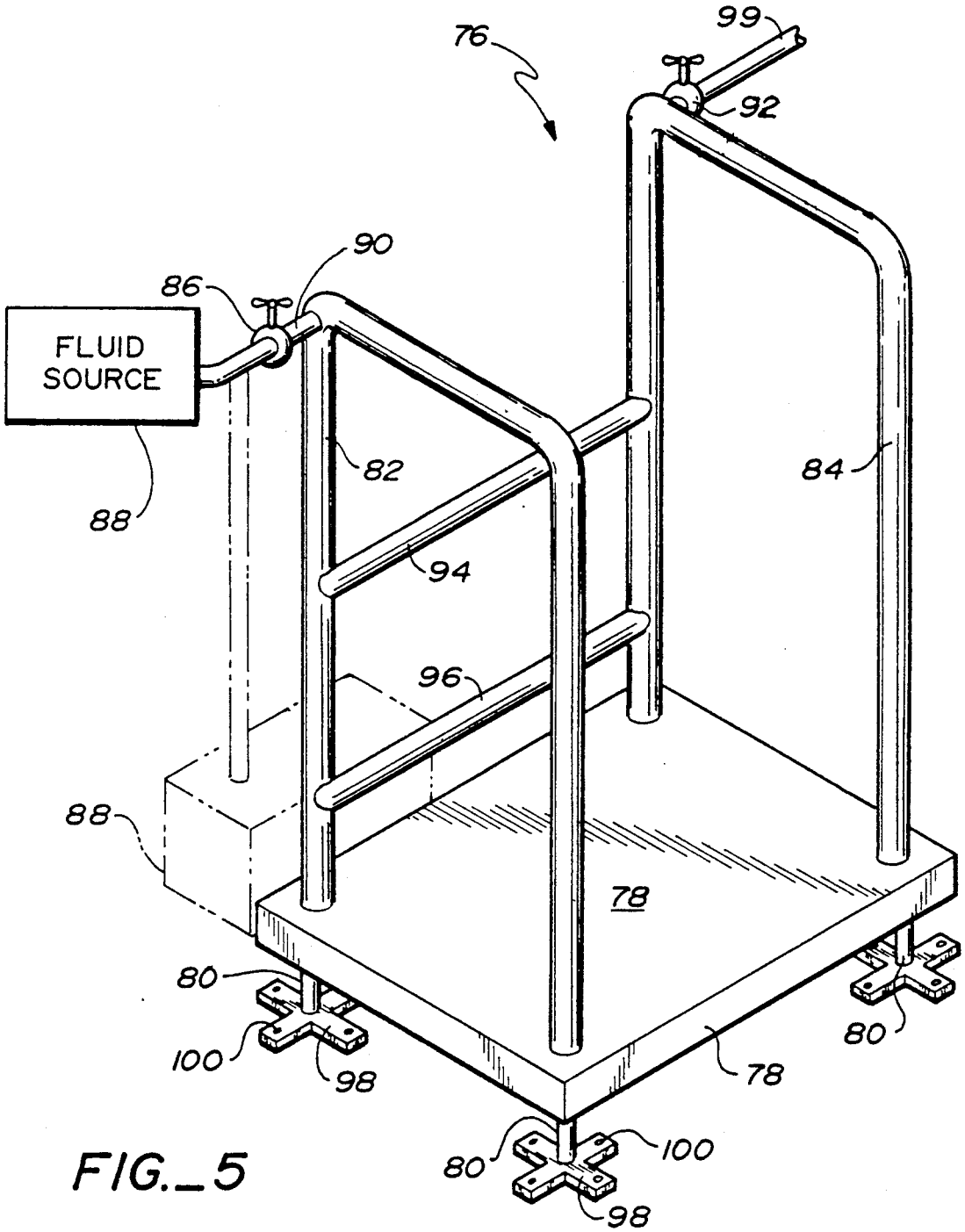
FIG. 5 is a top perspective view of an alternative embodiment of the subject vertically adjustable work station assembly constructed in accordance with the invention.

FIG. 5 is a perspective view of an alternative embodiment of the subject vertically adjustable work station assembly, generally indicated 76, which utilizes a fluid system to elevate and lower platform 78. As found in the embodiment disclosed in FIGS. 1–4, vertically adjustable work station 76 includes four stationary posts 80 which extend vertically from a ground surface and telescope into the vertically extending portions of generally U-shaped side rail members 82 and 84. The side rail members are preferably hollow to provide a fluid cylinder portion of the hydraulic system, and the stationary posts serve as pistons, as will be described in more detail in conjunction with FIG. 6.

Work station assembly 76 also includes an inlet valve 86 which is connected to a fluid source 88 containing fluid under pressure, such as an oil, plant system water, or a compressed gas. When fluid valve 86 is in an open position, high pressure fluid flows from fluid source 88 into one of side rail members 82 through a fluid conduit 90, which may be threadably coupled to inlet stub 102. Inlet valve 86, thereby, permits selective pressurization of side rail member 82 which is in fluid communication with side rail 84 by reason of transversely extending conduit and rail member 94. An outlet valve 92 is connected to side rail member 84 to permit selective discharge of fluid from side rail members 82 and 84 through a fluid conduit 99.

Fluid handling conduit 94 transversely connect side rail members 82 and 84 to equally pressurize the fluid cylinder side rail members. Second transverse rail member 96 functions as a foot rest member, but it will also be understood that member 96 can function as an equalizing conduit between the side rail assemblies. In addition, a person standing on platform 78 may lean against either of fluid conduit 94 or member 96 to attain a comfortable working posture.

If it is desirable to permanently secure the present vertically adjustable work station to a ground surface, a foot assembly 98 may be connected to each stationary post 80. Foot assemblies 98 are then bolted to the ground or support surface 101 by bolts 100.

Figure 6:
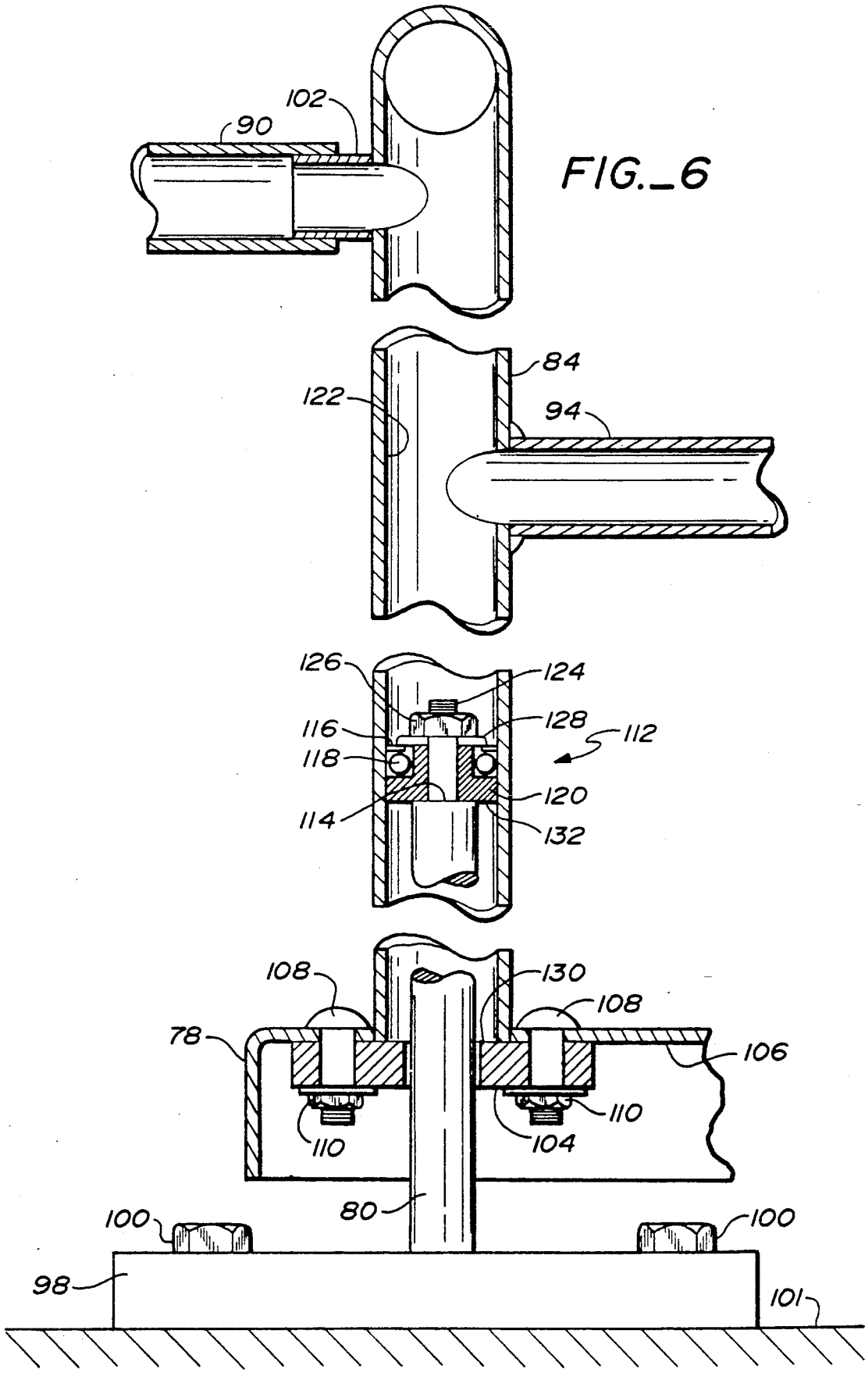
FIG. 6 is an enlarged, fragmentary side elevation view, in cross section, of one side of the platform and rail assembly of FIG. 5.

FIG. 6 shows that stationary post 80 is telescoped inside a vertically extending tubular portion of side rail member 84. Stationary post 80, which serves as a piston, is stabilized inside rail member 84 by guide plate 104 which has a central aperture of slightly larger diameter than the diameter of stationary post 80 for sliding receipt of post 80. Plate 104 is releasably mounted on the downwardly facing side 106 of platform 78 by bolts 108 and nuts 110.

An O-ring seal assembly 112 is positioned at an upper end 114 of stationary post 80 to provide a sliding fluid seal between stationary post 80 and movable side rail member 84. An O-ring seal member 116 is seated on annular shoulder 118 of a backing member 120. O-ring assembly 112 extends outward in sliding and sealed engagement with the interior surface 122 of side rail member 84. Extending upward from upper end 114 of stationary post 80 is a threaded post 124 which passes through a central aperture in backing member 120. A nut 126 is threadably attached to post 124 to secure O-ring seal 116 between upper end 114 of stationary post 80 and a washer 128, thereby preventing the O-ring seal assembly 112 from being vertically displaced during movement of side rail member 84 in relation to stationary post 80.

The interaction of the above described components of the fluid system will now be described. Initially, a high pressure fluid is introduced into side rail member 84 through inlet valve 86. Fluid will travel through fluid handling conduit 94 to distribute fluid from side rail member 82 to side rail member 84 to equally pressurize both side rail members. Once the side rail members are filled with the high pressure fluid which acts on the area of the four pistons (the seal ends of posts 90), and once the force of that applied pressure is sufficient to exceed the weight of platform 78 and the rail assemblies, side rail members 82 and 84 rise away from stationary posts 80. Since platform 78 is secured to side rail members 84 and 86, platform 78 is also elevated. When platform 78 has reached a desirable height, inlet valve 86 is closed to prevent further pressurization and displacement of the side rail members. Platform 78 may be elevated to a maximum position where the upper surface 130 of plate 104 contacts the lower surface 132 of backing plate 120.

In order to lower platform 78, outlet valve 92 may be opened to discharge fluid from the side rail members which, in turn, reduces the fluid pressure within the side rail members and permits the side rail members to sink in relation to stationary posts. For most manufacturing plants or food processing plants, the water system pressure is sufficient that raising of the platform can be accomplished with a worker standing on the platform. It will be apparent that even in lower pressure systems lowering of the platform can be easily accomplished while the worker is standing on the platform.

In another aspect of the embodiment of the subject invention of FIGS. 5 and 6, fluid source 88 may be a gas container mounted to the work station assembly by, for example, a bracket and strap arrangement. Thus, a high pressure gas, such as nitrogen or compressed air, can be introduced into the side rail members. In such an embodiment, outlet valve 92 could then be used to vent the gas to the atmosphere.

Although the above-described hydraulic embodiment is preferred, in another aspect of the subject invention, the stationary posts are tubular and serve as fluid cylinders, and the side rail members are formed as solid pistons telescoped inside the posts.

Figure 7:
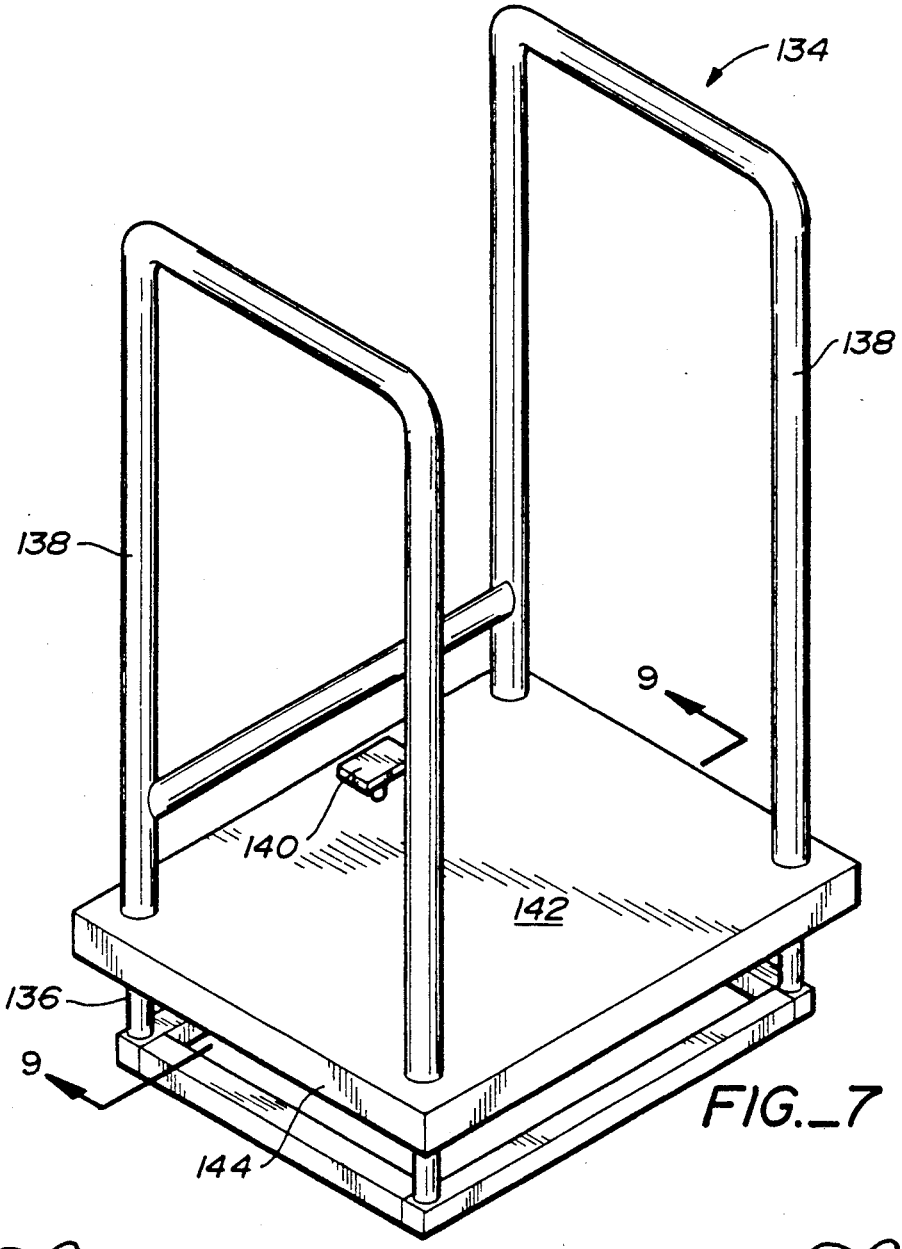
FIG. 7 is a top perspective view of a further alternative embodiment of the subject vertically adjustable work station assembly constructed in accordance with the invention.
Figure 9:
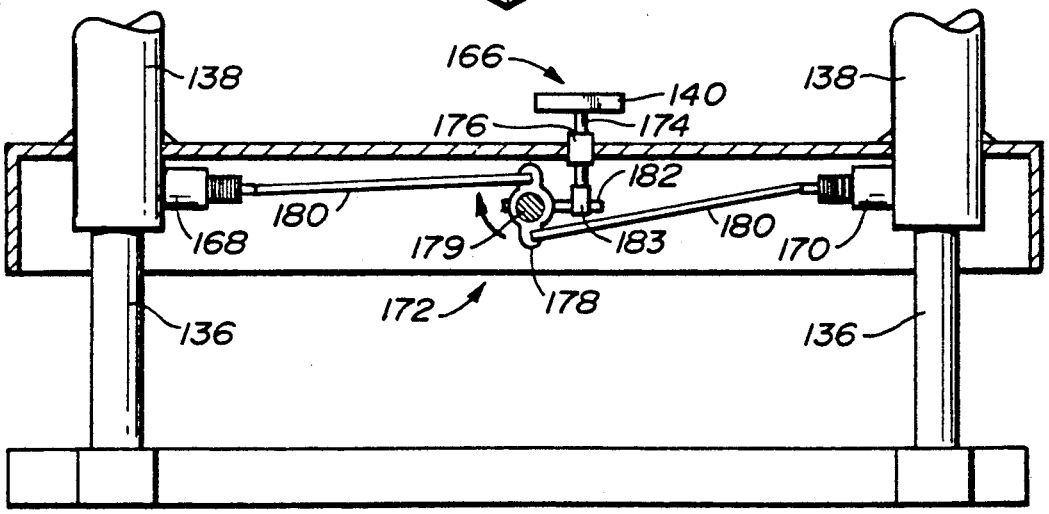
FIG. 9 is a fragmentary side elevation view, in cross section, of the lower portion of the subject work station assembly, as taken substantially along line 9—9 in FIG. 7.
Figure 8:
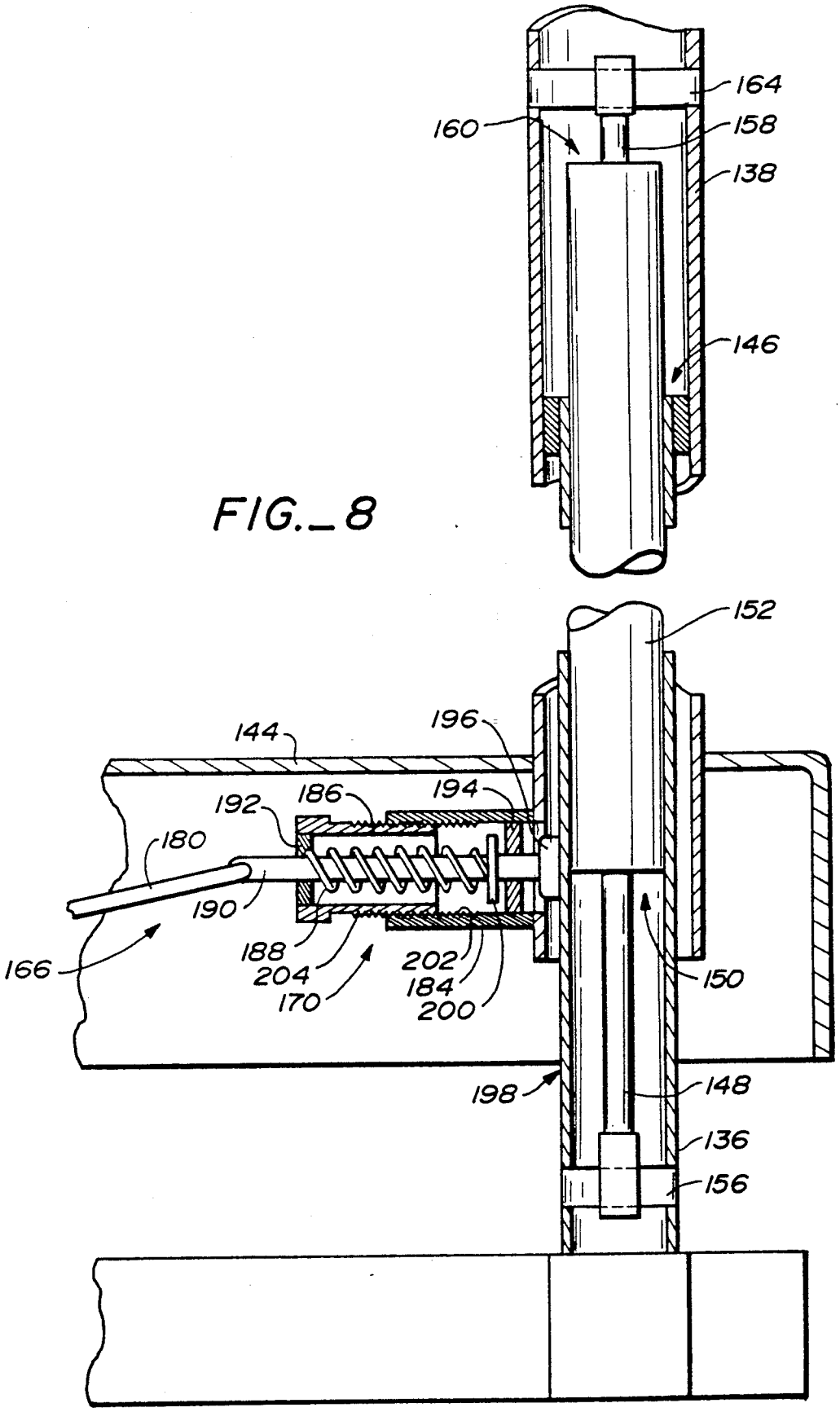
FIG. 8 is an enlarged, fragmentary side elevation view, in cross section, of one side of the platform and rail assembly of FIG. 7.

FIGS. 7–9 illustrate a further alternative embodiment of the subject work station assembly. FIG. 7 shows a vertically adjustable work station 134 having stationary posts 136 telescoped into vertically extending portions of generally U-shaped side rail members 138. A foot actuated pedal 140 is mounted to an upper side 142 of platform 144 for controlling vertical displacement of side rail members 138 in relation to stationary posts 136, as will be described in more detail below.

A constant force pneumatic spring 146 is shown in FIG. 8 mounted inside post 136. Such constant force springs are widely commercially available, for example, the spring marketed under the trade name Powerise Pneu-Spring. Spring 146 is coupled between stationary post 136 and side rail member 138. A piston 148 extends from a lower end 150 of spring cylinder 152 and is fixedly mounted to post 136 by a pin 156. A mounting rod 158 extends from an upper end 160 of cylinder 152 and is fixedly secured to side rail member 138 by pin 164.

Pneumatic spring biases platform 144 in an upward direction relative to stationary post 136 and delivers a constant upward force to platform 144 over the piston stroke. The biasing force applied to platform must be more than the weight of the platform alone and less than the combined weight of platform and the weight of a person standing on platform. In this connection, in a preferred embodiment, the biasing force of each pneumatic spring is approximately equal to 30 pounds or a total of 120 pounds for all four post assemblies, and the weight of the platform is approximately 40 pounds. Therefore, a person weighing only 81 pounds, in combination with the 40 pounds of the platform, have enough weight to overcome the upward biasing force of the pneumatic springs.

A standard compression spring may be substituted for the constant force pneumatic spring; however, a pneumatic spring is preferred over a compression spring because pneumatic springs deliver a constant force over the stroke as opposed to an accumulated force.

A frictional brake assembly, generally designated 166, is shown in FIGS. 8 and 9 and is transversely mounted beneath platform 144 between side rail members 138. Frictional brake assembly 166 serves to releasably secure platform 144 against movement relative to stationary posts 136 for selectively adjusting the vertical height of platform 144. Brake assembly 166 generally includes a pair of frictional brakes 168 and 170 and a brake release assembly 172.

Brake release assembly 172 is actuated by foot pedal 140. Foot pedal 140 includes a rod 174 which extends through sleeve 176 and platform 144. Sleeve 176 may be welded or otherwise secured to platform 144. Each frictional brake is connected by spokes 180 to a rotatable brake release crank member 178, which is keyed for rotation with shaft 179, as indicated by the arrow in FIG. 9.

A transversely extending arm 182 is also fixedly secured to shaft 179, and a U-shaped lower end of rod 174 slidably engages arm 182 to permit downward displacement of arm 182 and rotation of shaft 179. In order to release frictional brakes 168 and 170 from side rail members 138, therefore, brake pedal 140 is depressed, which in turn causes rod 174 to rotate shaft 179 and brake release crank member 178 in a clockwise direction, as indicated by the arrow. Rotation of release crank member 178 causes spokes 180 to pull the frictional brake shoes 196 (FIG. 8) away from exterior surface 198 of the stationary posts 136.

Turning back to FIG. 8, frictional brake 170 generally includes an stationary housing member 184, an adjustable housing member 186, a compression spring 188, a moveable brake rod 190, and guide plates 192 and 194. Brake rod 190 has a brake shoe 196 which preferably has an arcuate inner surface that frictionally engages an exterior surface 198 of stationary post 136. Brake rod 190 is channeled through central apertures in guide plates 192 and 194 and attached to spoke 180. Spring 188 is maintained in position between guide plate 192 and an annular washer 200 mounted for movement with rod 190. Stationary housing member 184 has internal threads 202 for mating engagement with external threads 204 of adjustable housing member 186. The frictional force applied by brake 170 to stationary post 136 may be adjusted by tightening or, alternatively, loosening the adjustable housing member 186 relative to stationary housing member 184, which effects compression of spring 188. As will be appreciated, the total frictional braking capacity of the assembly must be adjusted to be capable of holding the weight of the platform with a worker on it at any desired height.

It is preferred that a brake assembly be provided at each of posts 136. To this end, shaft 179 can extend across platform 144 to a second crank member 178 and second set of spokes for simultaneous release of a second set of brakes.

In FIG. 8, platform 144 is shown in a slightly elevated position. In order to lower platform 144, a person must stand on platform 144 and step on foot pedal 140 to retract brake rod 190 against the force of spring 188 and release the brake 170 from stationary post 136, as described above. While brake rod 190 is in a retracted position, side rail members 138 are displaced downward in relation to stationary posts 136 due to the combined weight of the platform and the person standing on the platform. When the platform reaches the desirable level, the person releases the foot pedal 140, and brake shoes 196 are permitted to spring forward to frictionally engage stationary posts 136.

To elevate platform 144, a person stands off of the platform and, while not standing on the platform, actuates foot pedal 140. Since the upward biasing force is greater than the weight of the platform, arm rail members 138 are displaced upward in relation to stationary posts 136 due to the upward biasing force of the pneumatic springs, thereby elevating platform 144.

All three embodiments of the work station of the present invention employ compact telescoping of the ground engaging posts relative to the platform rail assembly. Moreover, the platform height can be continuously adjusted from a position very close to the ground to a substantially elevated position, for example, 9 to 18 inches above the ground. The platforms include back and footrests which function to additionally stabilize the arm rests and can function as a part of the platform elevating assembly. In each embodiment vertical adjustment can be rapidly and easily accomplished, and the work station is suitable for retrofitting to a wide variety of applications.

In describing the invention, reference has been made to a preferred embodiment and illustrative advantages of the invention. Those skilled in the art, however, and familiar with the instant disclosure of the subject invention, will recognize additions, deletions, modifications, substitutions, and other changes which will fall within the purview of the subject invention and claims.

What is claimed is:

1. A vertically adjustable work station assembly comprising:

a plurality of relatively spaced apart, externally threaded vertically extending stationary posts having lower ground engaging ends;

a plurality of gear nuts each having a threaded interior bore therethrough, each being threadably and rotatably mounted on one of said stationary posts, said gear nuts further each having an upwardly facing smooth support surface thereon and a plurality of longitudinally extending ribs on an exterior surface thereof;

a platform formed for support of a person thereon and extending transversely between said gear nuts, said platform being in slidable contact with and supported on the support surfaces of said gear nuts for rotation of said gear nuts relative to said platform;

hand crank means supported by said platform and extending upwardly from said platform to a height sufficient for operation by a person while standing on said platform; and a rotatable gear driven by said hand crank means, ribbed belt means extending around and interengaged with each of said gear nuts to substantially simultaneously rotate said gear nuts on said stationary posts to produce simultaneous vertical displacement of said gear nuts relative to said stationary posts while said platform and hand crank means are supported on said gear nuts to enable adjustment of the vertical height of said platform and said hand crank means relative to said stationary posts.

2. A vertically adjustable work station assembly as defined in claim 1 wherein:

a side rail assembly mounted on said platform and having vertically extending portions which extend upwardly from said platform; and said stationary posts are mounted in relative telescoped relation with said vertically extending portions of said side rail assembly.

3. A vertically adjustable work station assembly as defined in claim 2 wherein said vertically extending portions comprise:

a pair of U-shaped side rails mounted on opposed sides of said platform and extending vertically to at least about waist height of a person standing on said platform.

4. A vertically adjustable work station assembly as defined in claim 3 and further comprising:

a back support member transversely extending between said pair of U-shaped side rails.

5. A vertically adjustable work station assembly as defined in claim 3 and further comprising:

a foot support member transversely extending between said pair of U-shaped side rails.

6. A vertically adjustable work station assembly as defined in claim 1 and further comprising:

a side rail assembly mounted on said platform and extending vertically from said platform means to at least about waist height of a person standing on said platform; and said hand crank means being mounted to said rail assembly.

7. A vertically adjustable work station assembly as defined in claim 1 wherein:

said support surfaces of said gear nuts are formed from a material having a low coefficient of friction.

* * * * *